US010122077B2

(12) United States Patent
Fröhler et al.

(10) Patent No.: US 10,122,077 B2
(45) Date of Patent: Nov. 6, 2018

(54) MOBILE RADIO ANTENNA

(71) Applicant: KATHREIN-WERKE KG, Rosenheim (DE)

(72) Inventors: Christian Fröhler, Riedering (DE); Christoph Staita, Brannenburg (DE); Tobias Krasny, Rosenheim (DE); Peter Feistl, Aschau (DE); Maximilian Göttl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 15 days.

(21) Appl. No.: 15/112,900

(22) PCT Filed: Dec. 18, 2014

(86) PCT No.: PCT/EP2014/003418
§ 371 (c)(1),
(2) Date: Jul. 20, 2016

(87) PCT Pub. No.: WO2015/110136
PCT Pub. Date: Jul. 30, 2015

(65) Prior Publication Data

US 2017/0040679 A1 Feb. 9, 2017

(30) Foreign Application Priority Data

Jan. 23, 2014 (DE) ..... 10 2014 000 964

(51) Int. Cl.
*H01Q 1/42* (2006.01)
*H01Q 1/24* (2006.01)
(Continued)

(52) U.S. Cl.
CPC ..... *H01Q 1/42* (2013.01); *H01Q 1/246* (2013.01); *H01Q 15/16* (2013.01); *H01Q 19/108* (2013.01); *H01Q 21/26* (2013.01)

(58) Field of Classification Search
CPC ..... H01Q 1/42; H01Q 1/24
(Continued)

(56) References Cited

U.S. PATENT DOCUMENTS 6,034,649 A * 3/2000 Wilson ..... H01Q 1/246 343/795
6,072,439 A * 6/2000 Ippolito ..... H01Q 1/246 343/795
(Continued)

FOREIGN PATENT DOCUMENTS

CN 2696143 Y 4/2005
CN 1855621 A 11/2006
(Continued)

OTHER PUBLICATIONS

International Search Report and Written Opinion for PCT/EP2014/003418, dated Apr. 1, 2015, 18 pages.
(Continued)

*Primary Examiner* — Huedung Mancuso
(74) *Attorney, Agent, or Firm* — Nixon & Vanderhye P.C.

(57) ABSTRACT

A mobile radio antenna includes a complete reflector is formed as one piece or by or connected to the at least one or more reflectors, or comprises at least one or more reflectors. The complete reflector comprises on the two outer longitudinal sides thereof extending in the longitudinal direction a first shield wall which shields the first and/or passive component space and/or distribution space, and a second shield wall connects directly or indirectly to the first shield wall. The two second shield walls extending on the longitudinal sides of the complete reflector protrude in the backwards direction of the antenna across a mounting plane or a section plane along which plane the first or passive component space and/or distribution space is separated or divided from the second or active component space.

20 Claims, 8 Drawing Sheets

(51) Int. Cl.
*H01Q 15/16* (2006.01)
*H01Q 19/10* (2006.01)
*H01Q 21/26* (2006.01)

(58) Field of Classification Search
USPC ..... 343/872
See application file for complete search history.

(56) References Cited

U.S. PATENT DOCUMENTS

| | | | | |
|---|---|---|---|---|
| 6,924,776 | B2 * | 8/2005 | Le | H01Q 1/246 343/792.5 |
| 7,173,572 | B2 * | 2/2007 | Teillet | H01Q 1/246 343/795 |
| 8,416,144 | B2 | 4/2013 | Lindberg et al. | |
| 9,590,317 | B2 * | 3/2017 | Zimmerman | H01Q 1/42 |
| 2007/0001923 | A1 | 1/2007 | Slattman et al. | |
| 2009/0066602 | A1 | 3/2009 | Lindberg et al. | |
| 2010/0134374 | A1 | 6/2010 | Skalina et al. | |
| 2012/0220339 | A1 | 8/2012 | Johnson et al. | |

FOREIGN PATENT DOCUMENTS

| | | |
|---|---|---|
| CN | 101548433 A | 9/2009 |
| DE | 29 910 570 | 9/1999 |
| DE | 103 16 787 | 11/2004 |
| DE | 10 2005 005 781 | 8/2006 |
| DE | 20 2009 001821 | 5/2009 |
| EP | 2 079 132 | 7/2009 |
| EP | 2 521 219 | 11/2012 |
| WO | WO 2010/036078 | 4/2010 |

OTHER PUBLICATIONS

Search Report for DE 10 2014 000 964.5, dated Mar. 19, 2014, 6 pages.

English translation of the International Preliminary Report on Patentability and Written Opinion of the International Searching Authority dated Aug. 4, 2016, issued in corresponding International Application No. PCT/EP2014/003418.

* cited by examiner

MOBILE RADIO ANTENNA

This application is the U.S. national phase of International Application No. PCT/EP2014/003418 filed 18 Dec. 2014, which designated the U.S. and claims priority to DE Patent Application No. 10 2014 000 964.5 filed 23 Jan. 2014, the entire contents of each of which are hereby incorporated by reference.

The invention relates to an antenna, in particular a mobile communication antenna, according to the preamble of claim 1.

Mobile communication antennas of the present generation conventionally comprise a single-, dual- or multi-column antenna array having in each case an associated reflector which is oriented vertically or predominantly vertically. The respective radiators and radiator devices for sending and/or receiving the signals are arranged one above the other on the front side of the reflector. Such radiator devices can be linearly polarised radiator devices or, for example, dual-polarised radiator devices, which are oriented preferably at an angle of ±45° to the horizontal or vertical. In this respect, they are frequently also referred to as X-polarised radiator devices. The antenna can be in the form of a mono-band antenna, a dual-band antenna or also a multi-band antenna in this case, which is thus able to radiate and/or receive in a plurality of frequency bands.

On the rear side of the particular reflector of the single- or multi-column antenna there can further be accommodated passive components, such as filters, adjusting elements such as phase shifters for adjusting the down-tilt angle, miscellaneous wiring, etc.

For mounting, a so-called shell reflector is frequently used, which is likewise at least U-shaped or approximately U-shaped in cross section. The shell reflector has a base plate which is arranged beneath the reflectors and at a distance therefrom in a shell reflector supporting plane, the reflector base plate merging at its two longitudinal sides into side walls or side flanks which are oriented perpendicularly to the shell reflector supporting plane or at least transversely thereto. These side flanks frequently terminate in the region of the reflector side webs of the single- or multi-column reflector arrangement. A radome which covers the radiator devices and the single- or multi-column reflectors is then fitted to the free edges of the side webs of the shell reflector supporting structure and is adhesively bonded or screwed to the sides.

Beneath the mentioned passive component and/or divider plane, which in some cases is also referred to as the passive component and/or divider compartment, additional active components, such as amplifier groups, a remote radio head, etc., can then also be accommodated on the actual rearward side of the shell reflector supporting structure opposite the radiators.

The object of the present invention is thus to provide an antenna, in particular a mobile communication antenna, which is improved and has improved mechanical and electrical properties.

The object is achieved according to the invention by the features described in claim 1. Advantageous embodiments of the invention are described in the dependent claims.

The antenna according to the invention is preferably a so-called active antenna having active components such as a remote radio head. In other words, it is an antenna or mobile communication antenna which is of highly compact construction, that is to say has a high packing density. In terms of its construction, the antenna is clearly structured and divided, since it comprises first an uppermost radiator and reflector plane, a passive component plane located therebeneath, which is then followed by a so-called active component plane situated beneath the passive component plane.

For such a structure, there is proposed within the scope of the invention a clear mounting and supporting structure which is simplified as compared with the prior art and nevertheless improved and which is able to absorb the corresponding loads, including the wind forces which may act upon the antenna.

In addition, there is also proposed within the scope of the invention an optimal screening function, namely for the passive component and/or divider plane (in which, for example, passive components as well as extensive wiring can be accommodated) but also for the active component plane which follows on the side facing away from the radiators.

Accordingly, the invention henceforth proposes that the at least single-column antenna for the radiators comprises a reflector which is part of a so-called complete reflector and as such is formed as one piece. It is a preferably integrally bonded structure, in which the conductive complete reflector so formed is in the form of a stamped and bent sheet metal part or, for example, in the form of a continuous cast extruded part.

The actual reflector supporting the radiator elements generally preferably merges via lateral side webs protruding transversely to the reflector plane in the direction of radiation and then ultimately into screening walls which extend to the rearward side, which projects beyond the passive component plane situated on the rear side of the actual reflector. In other words, all the passive components and the further devices provided in that plane or in that compartment, such as wiring, which are provided on the rear side of the actual reflector receiving the radiator elements, continue to be screened by the side wall webs.

However, it is further provided within the scope of the invention that said lateral screening walls which serve to screen the passive component plane (and which also perform a supporting function) are extended contrary to the direction of radiation of the radiators beyond a subsequent holding and mounting plane, namely beyond a so-called holding or mounting plane which serves for fixing and accommodating the active component belonging to the active component plane.

Such an arrangement produces a significantly improved screening action as compared with the prior art in respect of the electromagnetic properties and a significantly improved supporting structure, which allows all the components to be mounted accordingly and their weights and acting forces to be optimally absorbed and supported.

Accordingly, whereas there is provided in the prior art a shell reflector having a U-shaped cross section which is arranged at a rearward distance behind the actual single reflectors supporting the radiators (whereby suitable components can be accommodated in that distance compartment and the active components are then mounted on the rear side of said shell reflector), the invention, by contrast, proposes a complete reflector which, in cross section, has an approximately U-shaped cross section due to its general structure but is oriented and functions in the opposite functional direction to the shell reflector according to the prior art. This is because, in the complete reflector according to the invention, the radiators are seated on the base portion of the complete reflector on the outer side, that is to say the side which is opposite the side webs of the complete reflector. Within the at least approximately U-shaped complete reflector, the passive components and the wiring used for the division are then accommodated (at least for the large part) in a first passive component and/or divider compartment, there following on the side of said component and/or divider compartment that faces away from the radiators, above a holding and mounting plane so formed, an active component compartment in which especially the active components can be mounted and accommodated.

The complete reflector so formed offers optimal screening for the components accommodated therein, since the side webs of the complete reflector so formed are extended beyond the mentioned holding and mounting plane in the opposite direction to the radiators, so that not only the passive components accommodated inside the complete reflector and/or the wiring used for the division, but also the components following the holding and mounting plane are screened optimally, as compared with known solutions according to the prior art.

In a particularly preferred embodiment, it is further provided that the above-mentioned complete reflector, including the actual reflector portion holding the radiators and the associated passive component and/or divider compartment, can be covered by means of a radome. Particular preference is given to a variant in which the above-mentioned complete reflector having the corresponding components and the mounted radiators can be pushed from the front face into a corresponding radome which, apart from recesses discussed hereinbelow, is completely closed in the circumferential direction. This additionally produces an optimal protective effect. However, optimal bracing between the radome and the complete reflector is also achieved thereby, so that a further improved total supporting structure is achieved, as a result of which the entire supporting structure, in which the material of the actual complete reflector and/or of the radome is comparatively thinner, is able to absorb and support even higher loads. Ultimately, however, the wind forces which, for example, can act on the radome, can also thus be optimally absorbed and the antenna can be correspondingly supported.

In a preferred embodiment of the invention, the radome can be pushed onto the complete reflector in the axial direction in such a manner that the radome is able to be supported, inter alia, preferably in the region of the holding and mounting plane for the active components and/or on a plane offset thereto, preferably approximately at the level of the reflector portion on which the radiators are held and mounted. Material-thickening elevations, beads, etc. can preferably be formed here on the inner side of the radome, in the region of said supporting plane, which elevations additionally rest on a corresponding bearing surface of the complete reflector and are likewise supported here.

The invention provides further advantages when the mentioned antenna, and in particular the mentioned mobile communication antenna, is used not only for a single-column but, for example, for a dual- or multi-column antenna array. In such an embodiment, it is preferably provided that the two single reflectors or the plurality of single reflectors extending in parallel with one another, each of which forms an antenna column, are likewise formed as one piece, that is to say constitute part of the complete reflector. The reflector side web which is situated and conventionally provided between the two antenna columns and which rises perpendicularly or transversely from the reflector plane is also part of the mentioned complete reflector which, as mentioned, can be designed and produced in the form of a stamped and bent part or, for example, in the form of a continuous cast part.

The configurations of a comparable antenna known according to the prior art hitherto had a number of disadvantages, namely:

- the so-called shell reflector having the radome profile had to be adhesively bonded and/or screwed in a complex operation,
- in a multi-column antenna array, slots remained between the single reflectors, which slots had a disadvantageous effect,
- there were slots between the reflectors and the so-called shell reflector,
- there was no screening with respect to the electrical components and elements provided on the rear side of the antenna, and
- it was not possible to access the antenna from the front in the event of a repair since the radome was generally permanently adhesively bonded to the shell reflector.

By contrast, the present invention offers significant advantages, for example:

- since the at least one or the at least a plurality of reflector portions, including in the form of a complete reflector, provided for an antenna column in each case are in one piece, intermodulation products are avoided,
- in addition, screening that is improved overall is achieved, namely on the antenna rear side for the passive components and elements provided there in a first plane (compartment) and the active components in a second plane (compartment) situated beneath the first plane,
- the supporting structure as a whole is improved and is able to absorb and support significantly more load while having material thicknesses that are comparable with the prior art, which also means, conversely, that, when comparable weights and loads are supported, the complete reflector structure is of thinner-walled construction and the antenna as a whole is thus lighter,
- overall, the improved supporting structure achieved within the scope of the invention is distinguished by the combination of the complete reflector, for example in the form of a stamped and bent part or in the form of a continuous cast part, in conjunction with the radome, for example in the form of a GRP profile, which at least has portions which are closed completely in the circumferential direction,
- a closed profile is obtained overall, despite active components which are connected to the reflector via contact points, and
- the complete reflector having the associated antennas and the individual antenna structures can without problems be pushed axially out of or, conversely, into the radome during production and during servicing.

It has been found to be particularly advantageous if the antenna has, preferably in the region of the holding and/or mounting plane for the active components, a plug strip which is offset relative to that plane in the direction of the radiators, so that the mentioned complete reflector can be pushed into or out of the radome which is closed circumferentially over its axial length at least in certain portions.

By means of these measures, short cable connections can be achieved especially also when the plug strip is formed, for example, in the middle region of the antenna.

In summary, the advantages according to the invention can be described by the following key words:

- high flexural strength,
- low weight with a configuration of the antenna that is weight-optimised overall,
- high modulus of resistance,
- variable attachment system, simple manufacture, possibility of a radome profile that is closed in the circumferential direction, so that sealing is also simplified, the possibility of pushing the complete reflector comprising the antenna into and out of the radome when the radiators are mounted and active, reduced number of possible intermodulation sources, avoidance of slots between single radiators and/or a single radiator and a complete reflector provided in the prior art, improved screening of the rear side of the antenna as well as of the attachment points between the active components and the complete reflector, and establishing very flexible and rapid variant generation.

The invention will be explained in greater detail below by means of drawings, in which, in detail:

FIG. 1 is a schematic 3D view of a mobile communication antenna according to the invention;

FIG. 2*a* is a perspective view of the complete reflector according to the invention of the antenna or mobile communication antenna;

FIG. 2*b* is a horizontal section through a dual-column mobile communication antenna shown in FIG. 1, with active components omitted;

Figure 5B:
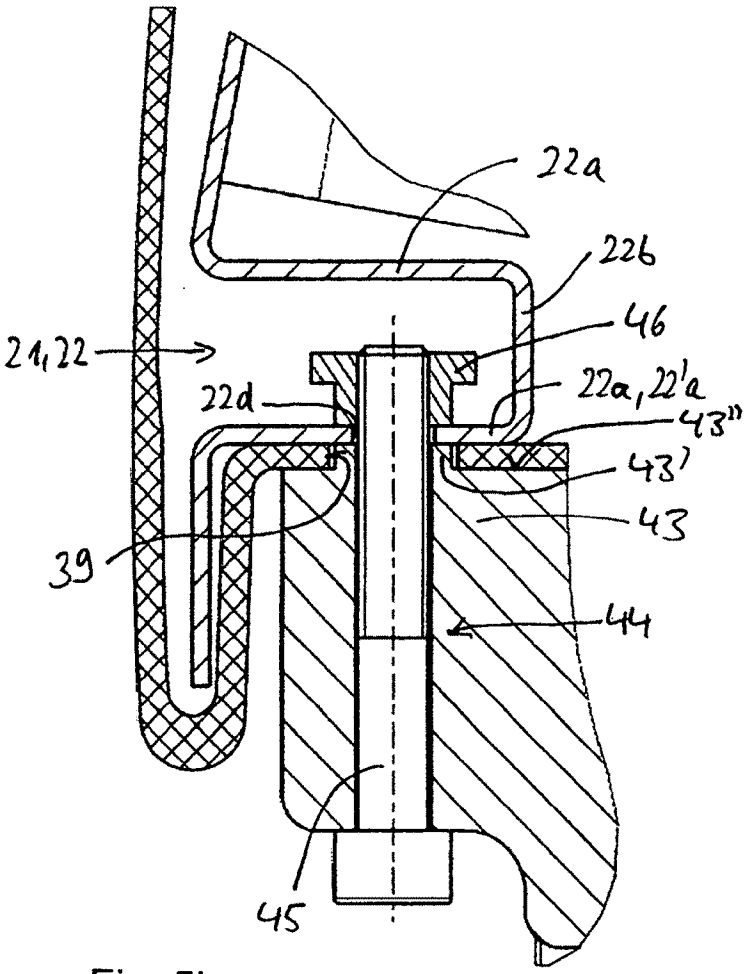
Figure 5A:
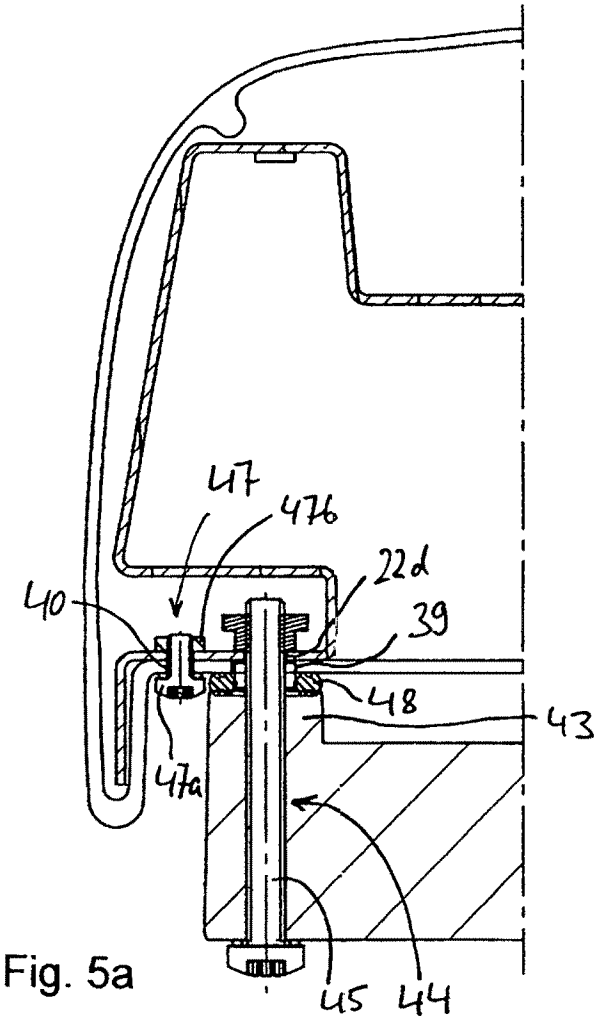

FIG. 5*a* shows an enlarged detail of an anchoring and mounting portion forming a mounting interface on which active components can be mounted;

FIG. 5*b* shows an embodiment modified with respect to FIG. 5*a;*

Figure 2A:
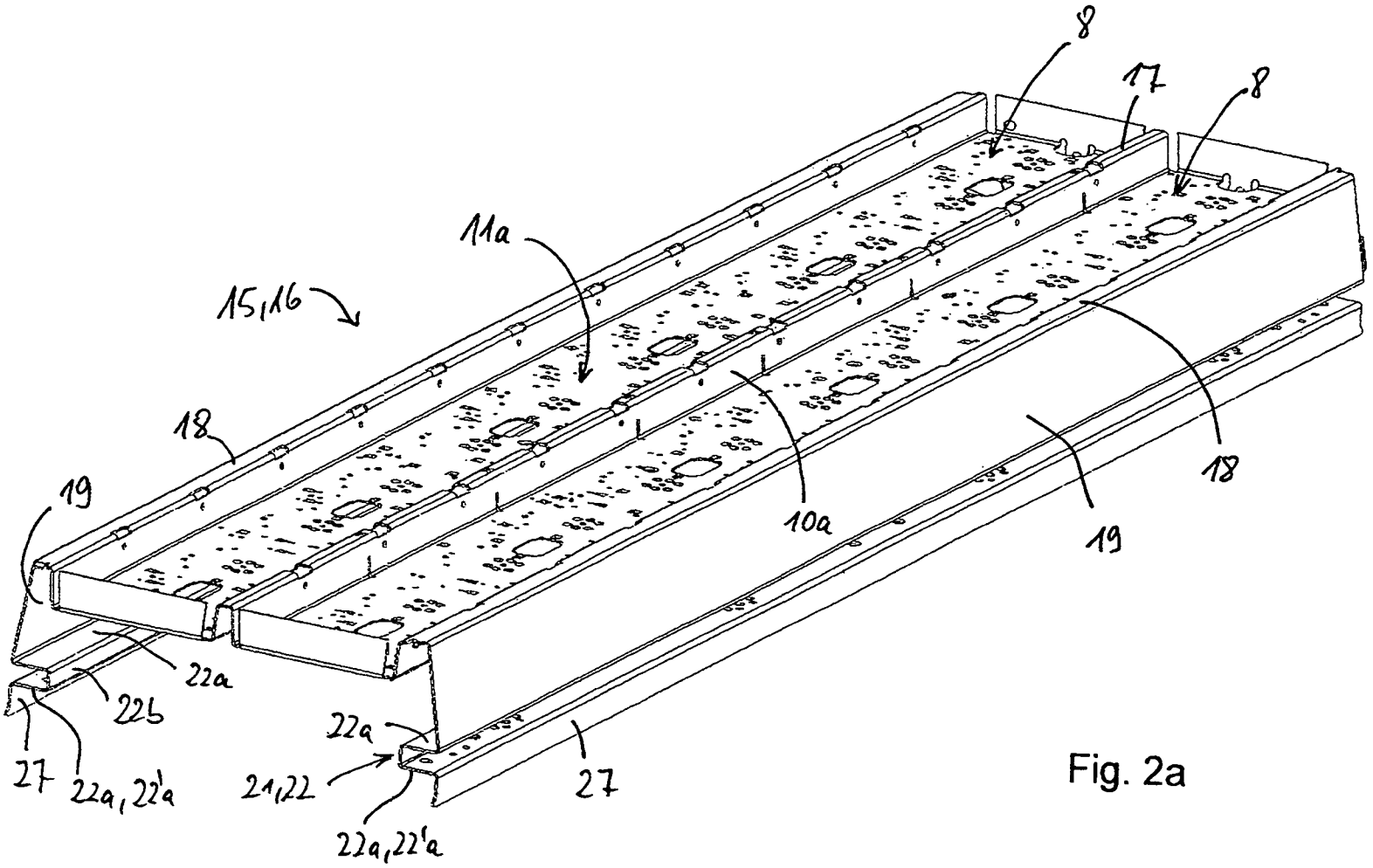
Figure 2B:
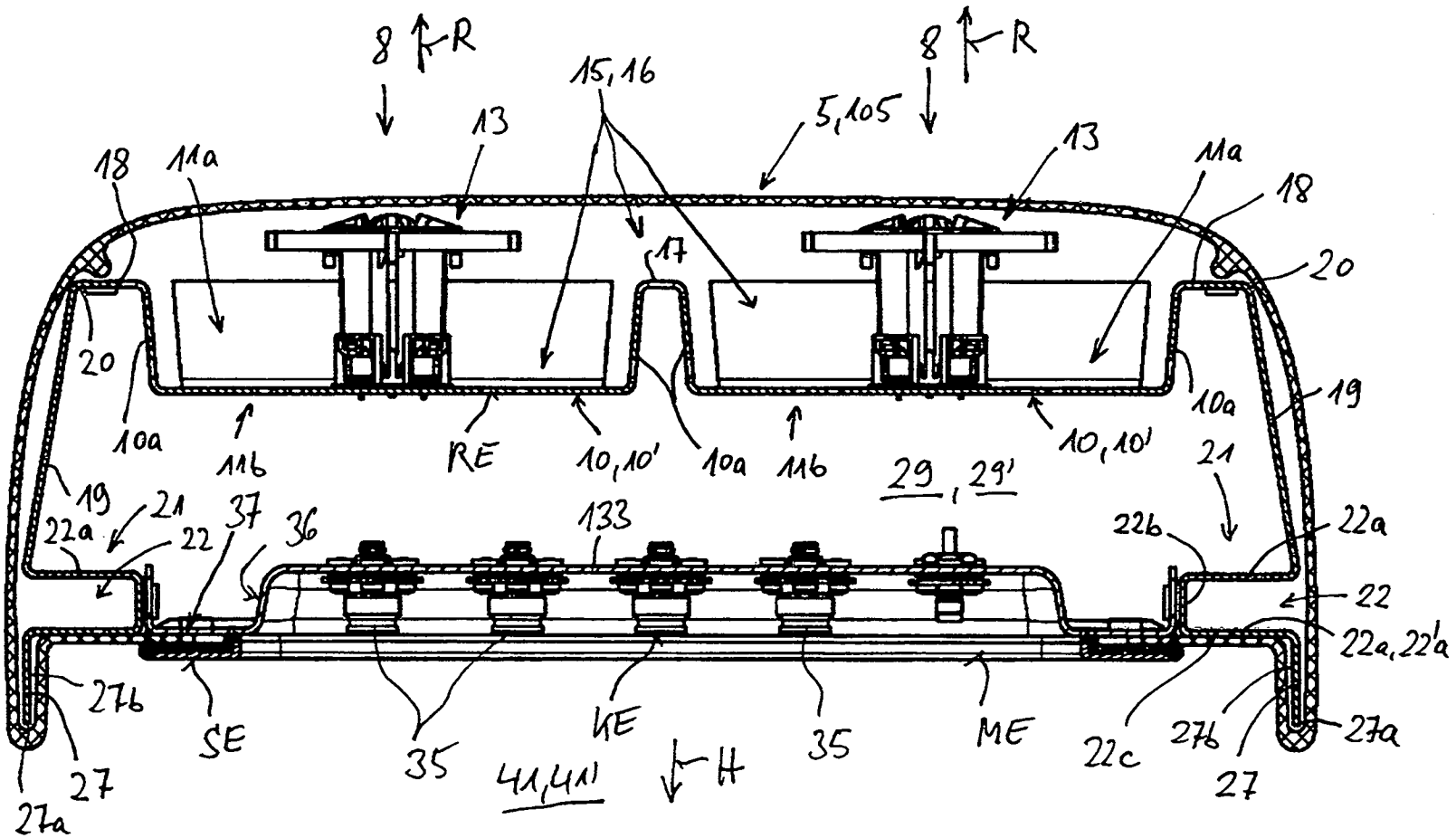
Figure 6:
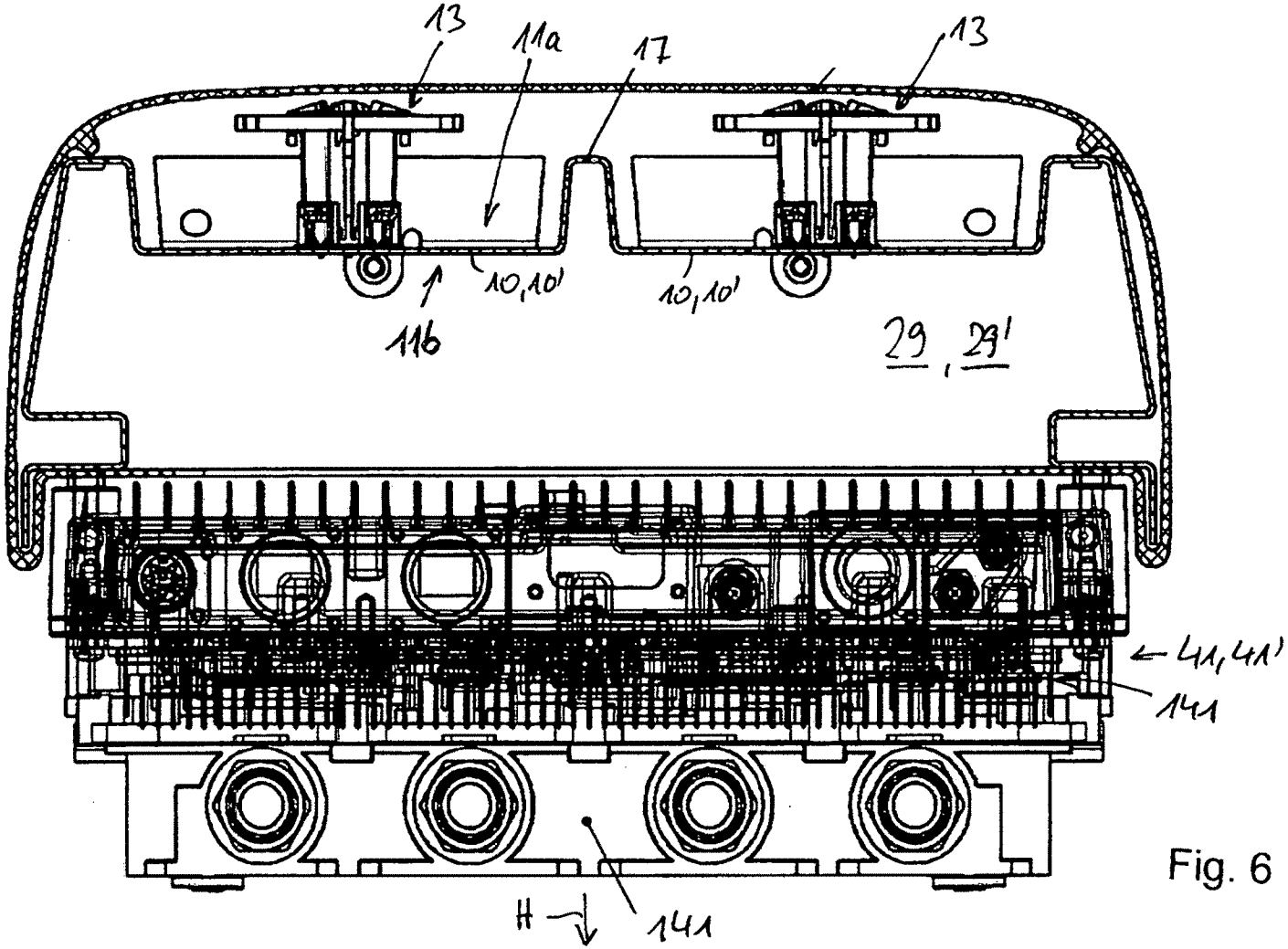
Figure 7:
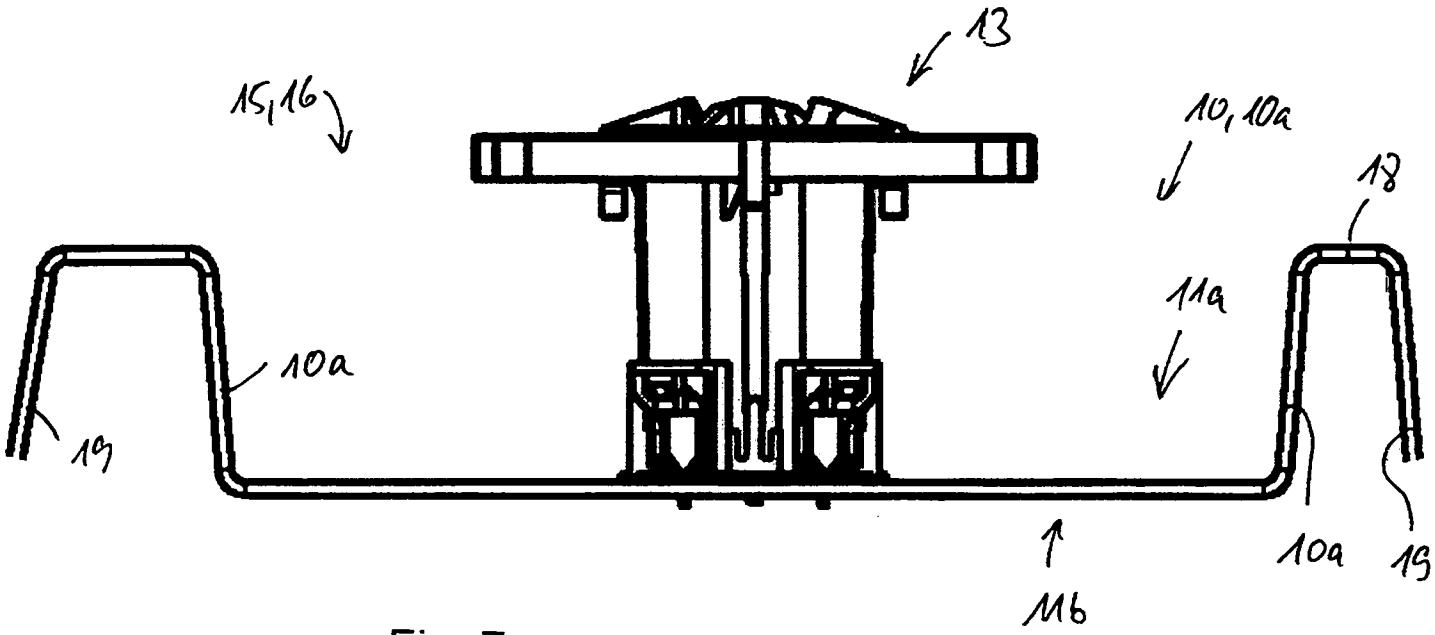
Figure 8:
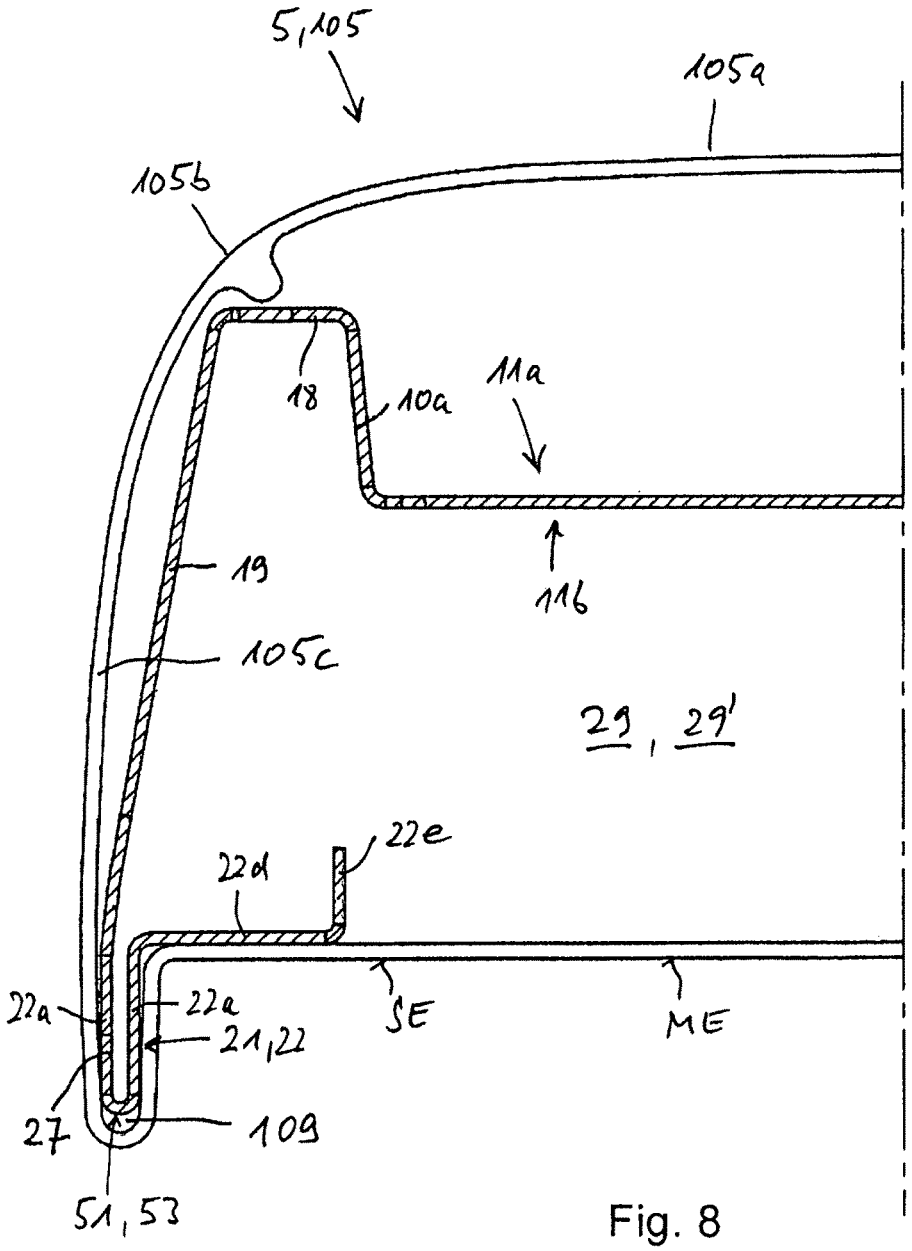

FIG. 6 is a cross-sectional view similar to FIG. 2*b* but with additional active components built on or built in;

FIG. 7 is a cross-sectional view through the antenna according to the invention which, in a departure from the preceding embodiments, comprises not two but only one antenna column; and FIG. 8 shows an embodiment which differs from the preceding embodiment having a slightly modified design of an anchoring and mounting shoulder at the level of the sectional plane for anchoring the active components.

Figure 1:
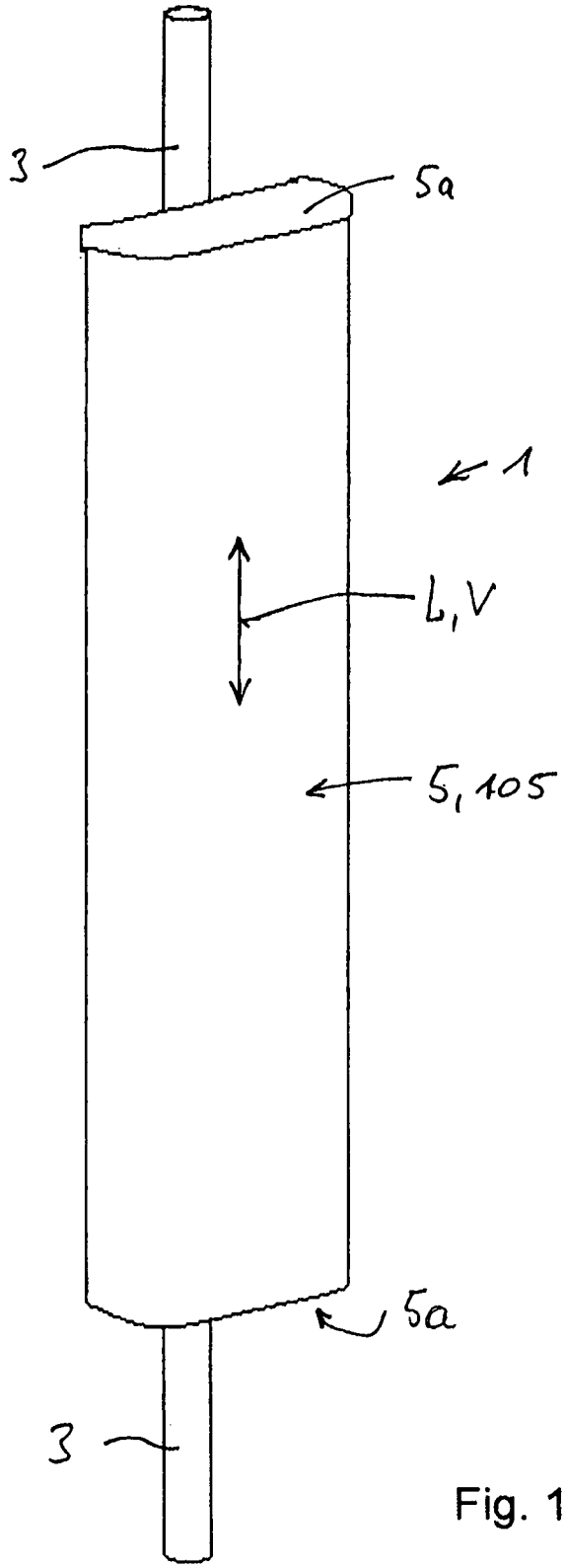

FIG. 1 is a schematic view of a first embodiment of an antenna 1, that is to say in particular of a mobile communication antenna 1, as is attached, for example, to a mast 3 or to another suitable location.

The mobile communication antenna comprises a housing or a cover 5 (the structure of which will be discussed in greater detail below) having a radome 105, as well as an upper and lower cover cap 5*a*. The connections provided for operation of the antenna, including the coaxial connections and the control connections, can be provided in particular in the lower cover cap 5*a*, without implying any limitation.

Such an antenna or mobile communication antenna 1 is conventionally positioned mounted in the vertical direction or predominantly in the vertical direction.

FIG. 2*a* is a 3D view of a complete reflector according to the invention, and FIG. 2*b* and FIG. 6 are horizontal sectional views through the mobile communication antenna 1 shown in FIG. 1. In a view according to FIG. 2*b*, the active components that are conventionally additionally provided on the rearward side of the complete reflector 16 are not shown.

It can be seen from these figures that the mentioned embodiment is an antenna, that is to say a mobile communication antenna, having two antenna columns 8 which extend in parallel with one another, that is to say are conventionally oriented in the vertical direction or predominantly in the vertical direction.

Each antenna column 8 comprises a reflector 10 having a reflector front side 11*a* and a reflector rear side 11*b*, in front of which there are generally arranged, in a known manner, a plurality of radiators or radiator groups 13 which are spaced apart from one another. They can be linearly polarised or dual-polarised radiators, etc., which radiate, for example, in two mutually perpendicular polarisation planes and are preferably oriented at a ±45° angle to the vertical or to the horizontal. Reference is made in this respect to known solutions, according to which corresponding dipole radiators or, for example, so-called vector radiators or even, for example, patch radiators, etc. can be used, which are part of a mono-band, dual-band or multi-band antenna arrangement.

In the embodiment shown, the two reflectors 10 each belonging to an antenna column 8 do not form single reflectors having an antenna column between them but are part of a common one-piece and, in the embodiment shown, integrally bonded complete reflector arrangement 15, which is also referred to in the following as the complete reflector 16 for short. It is further apparent from the figures that the reflector 10 provided for an antenna column 8, that is to say in the embodiment shown, the column reflector or part reflector 10' provided for an antenna column 8, is provided at its two sides each extending in the longitudinal direction L, that is to say conventionally in the vertical direction V, with a side web 10*a* which, for example, is oriented on the reflector front side 11*a* perpendicularly or, at an angle deviating therefrom, obliquely to the reflector plane RE. The side webs 10*a* each provided laterally with respect to an antenna column 8 are conventionally oriented relative to the radiators or radiator groups 13 provided therebetween such that they diverge slightly relative to one another in the direction of radiation R.

Each of the adjacent side webs 10*a* of the two adjacent antenna columns 8 are permanently connected together via a connection web 17, that is to say a so-called connection bridge 17, in this case. In other words, the two column reflectors or part reflectors 10' of the two antenna columns 8 form a common fixed, one-part reflector structure.

Each of the two side webs 10*a* situated on the outside and furthest away likewise merge on the radiation side of the reflector arrangement into an outwardly diverging connection web 18, which then merges via a further angled portion 20 into a first screening wall 19 which extends more or less contrary to the direction of radiation R of the antenna arrangement.

The mentioned connection webs 18 and the bridge web 17 can be situated at approximately the same level, that is to say preferably at the same level as or at the same distance from the reflector plane RE (although this is not essential) and can be oriented wholly or predominantly in parallel with the reflector plane RE.

The mentioned screening walls 19 extend in a slightly diverging manner in the rearward direction H; however, this is in principle not necessary.

The screening walls 19 are followed by an anchoring portion 21. That is to say, the two outer screening walls 19 extending in the rearward direction H merge into an anchoring portion 21, namely via a horizontal U-shaped mounting portion 22, the open region of which faces outwards in each case and which ultimately consists of two side webs 22*a* which are more or less parallel in the embodiment shown and are spaced apart from one another, preferably in parallel, in the direction of radiation or the front direction R and are connected together via a base web 22*b* which extends transversely or perpendicularly to the reflector plane RE.

The side web 22'*a* situated at a distance from the antenna columns 8 comes to lie in a mounting plane ME, in which or in the vicinity of which the active components, which will be discussed later, are then mounted.

Finally, the above-mentioned side web 22'*a* which is further away from the antenna columns 8 merges into a second screening wall 27, which is preferably an extension, as it were, of the first screening wall 19 and is separated therefrom only by the mentioned anchoring portions 21 formed in the manner of a horizontal U (whereby the anchoring portion 21 ultimately also serves as, and can be understood as being, a screening wall, either as an intermediate screening wall or as a screening wall which can be added to the first or to the second screening wall). This second screening wall 27 is likewise a one-part constituent of the complete reflector arrangement 15, that is to say of the complete reflector 16.

By means of such a structure, there is created a first receiving compartment 29 which is situated on the rearward side of the antenna columns 8, that is to say on the rearward side 11*b* of the column reflectors or part reflectors 10, and reaches or can reach as far as the region of the anchoring portion 21 or of the mounting plane ME. This first receiving compartment or region 29 forms a so-called first receiving plane 29, which is in some cases also referred to hereinbelow as the passive component and/or divider compartment 29 or the passive component and/or divider plane 29, which is completely screened by the reflector having its specific design.

This plane 29 or this region or this compartment 29 can therefore also be referred to in the broadest sense as a first or passive component and/or divider compartment because, in addition to first or passive components 129 (such as filters or, for example, phase shifters for setting a different downtilt angle of the radiators), in particular a plurality of cables can also be accommodated and laid here, via which the individual radiators and radiator groups are supplied with power.

Owing to the design of the first screening walls 19 provided on the outer longitudinal sides of the antenna, the devices and wiring, etc. accommodated in said passive component and/or divider compartment 29 are optimally screened.

Figure 3:
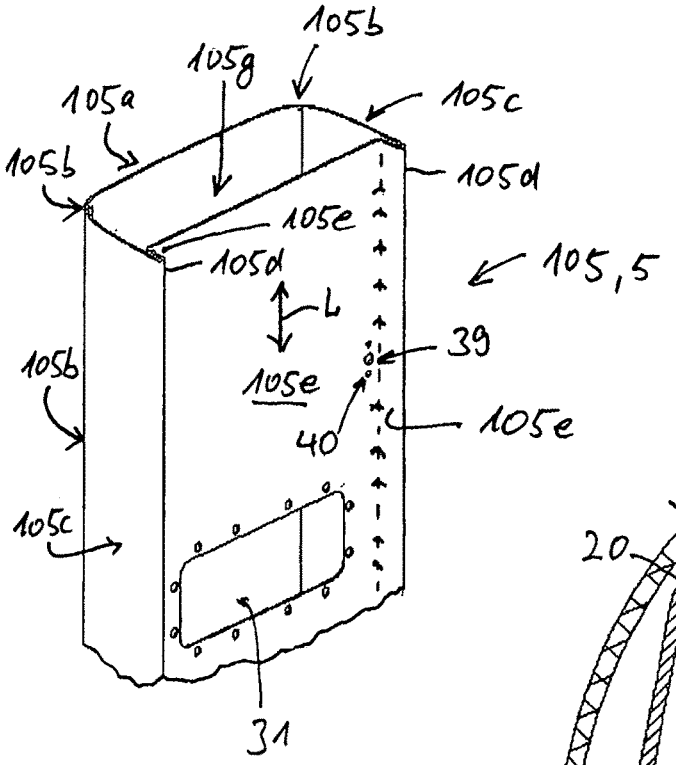
FIG. 3 is a predominantly rearward 3D view of a radome used within the scope of the invention.

FIG. 3 is a schematic, rather rearward 3D view of the radome 105, which forms part of the housing 5 as a whole. This radome, which consists of a GRP profile and is permeable to electromagnetic radiation, conventionally comprises a front side 105*a*, beneath which the antenna columns are provided with the radiators. This front side 105*a*, which can generally extend in the middle region relatively flat and at least approximately in parallel with the reflector planes RE, then merges at the longitudinal sides, via a curved portion 105*b*, into side portions 105*c*, which extend more or less adjacently to the first screening wall 19 and cover it on the outside.

Figure 4:
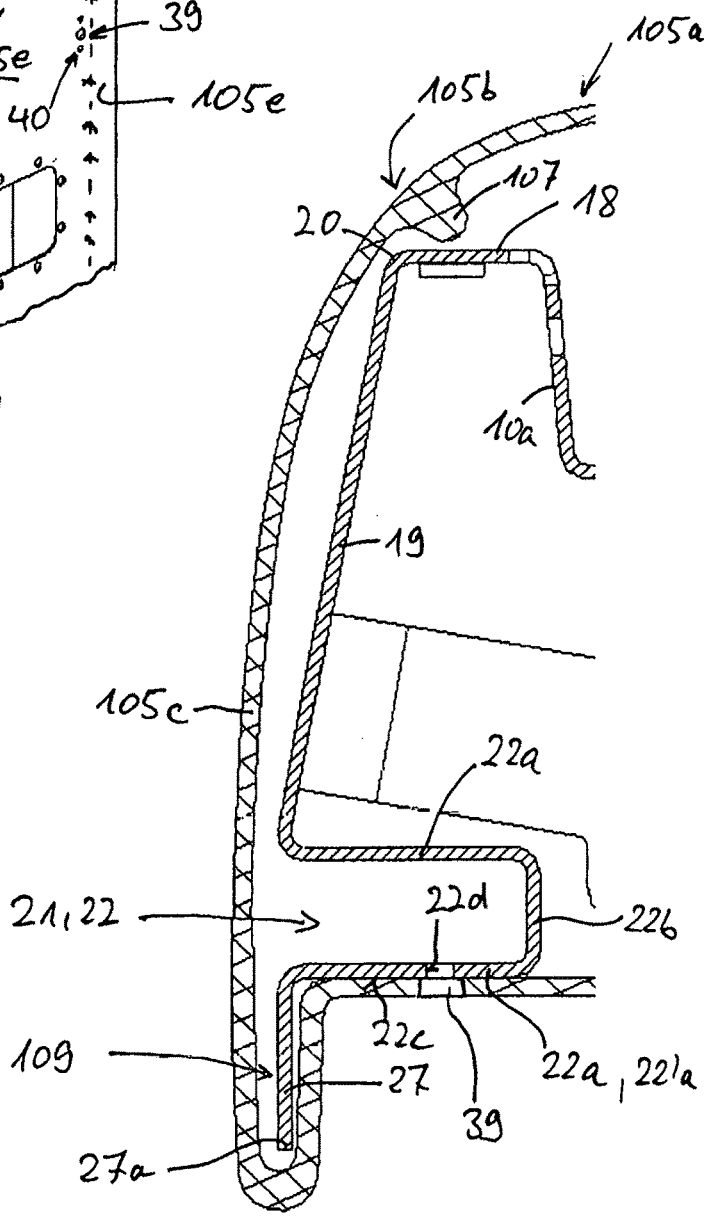
FIG. 4 is an enlarged partial view in respect of a cross section through the antenna shown by means of FIG. 2*b* for illustrating the shape of the complete reflector and of the radome surrounding the complete reflector.

It can further be seen from the views according to FIG. 2*b* and the partial section according to FIG. 4 that these side portions 105*c* of the radome 105 are of such a size that they extend as far as the lowermost limiting edge 27*a* of the second screening wall 27, that is to say the limiting edge furthest away from the radiators, where they have a narrowly defined curved portion 105*d* in order to form in each case an inner wall portion 105*e* on the inner sides 27*b* of the second screening wall 27 facing one another. On the side 22*c* (of the side web 22'*a* lying further away from the radiators) facing away from the radiators, these inner wall portions 105*e* taper towards one another in parallel with said side webs 22*a*, 22'*a*, so as to form a rear wall 105*f*. The rear side 105*e* of the radome 105 is thus formed, so that the whole of the interior 105*g* of the radome is in principle surrounded.

In the embodiment shown, the inner wall portion 105*e* extends in parallel with the correspondingly outer portion 105*d* of the radome, namely forming a pocket which in the embodiment shown extends in slot form or in groove form in the longitudinal direction L of the radome and which is open towards the interior 105*g* of the radome.

As can also be seen from the predominantly rearward view according to FIG. 3, some recesses are made in the rear side 105*f* of the radome.

One of the recesses 31 is in the form of a slot and extends in its longitudinal extent transversely to the longitudinal direction L of the antenna, preferably in the middle region of the radome.

Behind this recess 31 in the rear wall 105*f* of the radome 105 there is formed a so-called plug interface 33 (FIG. 2*b*), namely in the form of a plug strip 133 having plug-in connectors 35, generally coaxial plug-in connectors, mounted therein, that is to say seated next to one another. Relative to the rearward mounting plane ME (corresponding to the rear side 105*f* of the radome 105), said plug connectors are seated so as to be recessed towards the single reflectors 10, that is to say towards the component receiving compartment 29, so that the actual plug interface plane KE does not project beyond the plane ME of the rear side of the rear wall 105 of the radome.

In the cross section shown (FIG. 2*b*), the mentioned plug strip 133 also has at its ends facing the edge regions of the antenna an S- or Z-shaped contour 36 having a web 37 which extends at least outwards and then transversely to said contour, that is to say in parallel with the base web 22*b* of the anchoring portion 21. The plug strip 133 is then fixedly anchored there, for example by means of screws and nuts.

This overall design additionally offers the fundamental advantage that, for example, the mentioned complete reflector arrangement 15 in the form of the mentioned complete reflector 16 having radiators 13 mounted thereon and, for example, passive components accommodated in the passive component plane 29', that is to say the receiving compartment 29, and the wiring provided therein can be axially pushed in the finished mounted state into the radome 105, that is to say into the receiving compartment 105*g* in the radome 105.

Owing to the exact fit of the radome, said radome is connected to the complete reflector 16 in a buckling-resistant manner, so that the total load which can be absorbed by the overall structure, including the weights of the individual components and the wind load acting on an antenna, etc., is significantly higher than suggested by the individual components on their own.

In order to improve this buckling resistance, the mentioned radome 105 is not only fixedly and in particular rigidly connected on the rearward side in the region of its slot- and/or groove-shaped pocket 109 to the particular second screening wall 27 engaging therein, but also in that the inner side of the radome also rests and is supported on the complete reflector 16 at least at a second, different point. In the embodiment shown (see in particular the cross-sectional view according to FIG. 2*b* and the enlarged detail sectional view according to FIG. 4), this support takes place in the region of the upper curved portion 105*b*, at which the front side 105*a* of the radome 105 merges into the side portions 105*c*. For reinforcement, a longitudinally extending elevation or a longitudinally extending bead 107 or the like can be formed there on the inside, which elevation or bead rests, for example, on the outer connection web 18 of the complete reflector 16. Alternatively or in addition, the design could also be such that, for example, the edge region 20 between the outer connection webs 18 at the transition to the first screening wall 19 of the complete reflector 16 rests on the inner wall 108 of the radome and thereby results in a second support, so that the entire radome structure is connected in a largely buckling-resistant manner to the skeleton-like complete reflector 16 situated therein.

The width of the slot- or groove-shaped pocket 109 is adapted to the material thickness of the screening wall engaging therein and thus corresponds to the thickness of this screening wall or is at least slightly wider.

From the view according to FIG. 3, looking at the rearward side 105*f* of the radome 105, it can also be seen that, in the side longitudinal region, at intervals, further, generally bores, that is to say round recesses, 39 are also made. These recesses 39 are situated in the region of the U-shaped anchoring portion 21 of the complete reflector 16. Second or active components, such as amplifier assemblies, remote radio head, etc., can be accommodated there in the second and/or active component plane 41 situated at a distance from the radiators 13, that is to say in a so-called second or active component region or compartment 41. These second and/or active components 141 are also screened significantly more effectively as compared with conventional solutions, since the second screening wall 27 projects towards said second and/or active component region 41, that is to say beyond the mounting plane ME in the rearward direction H.

In order that these second and/or active components 141 which are to be accommodated in the second and/or active component plane or in the second and/or active component compartment 41 can be mounted correspondingly fixedly, laterally introduced screw connections 44 are provided, for example using screws 45 which engage in transverse orientation or perpendicular orientation to the mounting plane ME, that is to say also to the plug interface 33, through corresponding bores 22*d* (FIG. 4) into the lower web 22'*a* of the U-shaped anchoring portion 21, corresponding nuts 46 generally being held securely in position and securely against rotation by plastics holders. The plastics holders can be introduced into the U-shaped anchoring portions 21 from the outer sides and positioned at corresponding points congruently with the mentioned recesses 39 (FIG. 4), namely by a corresponding clamp fit, by means of which the plastics holders comprising the integrated nuts are held. This takes place before the correspondingly pre-mounted complete reflector 16 comprising the mounted first components 129 is pushed in in the axial direction of the radome 105. It is then merely necessary to screw the corresponding screws 45 through the bore openings 39 into the mentioned pre-mounted nuts 46, which are held fixed in the correct position in the plastics holders. The second and/or active components can thus be attached to the rear side 105*f* of the radome 5.

In order that effective galvanic contact is established between the active components 141 and the complete reflector 16, a recess 39 of correspondingly larger dimensions is made in the radome—as can be seen in a detail sectional view in FIG. 5*a*—so that the bearing or supporting feet 43 of the active components 141 rest directly on the metal of the complete reflector 16 in the region of the side web 22'*a* that is further away from the radiators, with the formation of galvanic contact. As is shown, in a departure therefrom, in FIG. 5*a*, the bearing side of the supporting feet 43 can have a larger transverse extent than the corresponding bore 39 in the radome, so that the bearing surface of the supporting feet 43 rests directly on the electrically non-conductive radome. It is also possible for a sealing or insulating ring 48, which is at least slightly resilient, to be inserted between the bearing surface of the supporting feet 43 and the material of the radome, adjacent to the opening 39. Adequate clamping forces are thus permanently generated and maintained.

In order in this region also to keep the adjacent wall portions of the radome 105 resting on the side web 22'*a* of the U-shaped anchoring portion 21 permanently anchored, a further screw connection 47 is introduced in parallel with the bearing feet 43, by which screw connection the material of the radome 105 is held on the corresponding metal side web 22'*a*. To that end, further recesses 40 are also provided in parallel with the first above-mentioned recesses 39, which further recesses are outwardly offset and generally have a smaller diameter, and through which corresponding screws 47*a* having corresponding nuts 47*b* can be tightened in order to achieve the above-mentioned effect.

It can be seen from the view according to FIG. 5*a* that the screw connection 47 and the particular bearing feet 43 arranged adjacently thereto comprising the screws 45 passing through the bearing feet 43 are arranged next to one another transversely and in particular perpendicularly to the longitudinal direction of the antenna, the screw connection 47 being positioned closer to the screening wall 27. However, in a departure from this embodiment, it is also possible that, for example, the bearing feet 43 and/or the screws 45 passing through the bearing feet 43, as well as the mentioned additional screw connections 47, can be arranged behind one another in the longitudinal direction of the reflector, that is to say in parallel with the adjacent screening wall 27.

Reference is also to be made to a further modification, with reference to FIG. 5*b*. FIG. 5*b* shows a variant in which the reflector, the radome and the active components are connected together by a screw connection, that is to say in the embodiment shown by the mentioned screws 45. To that end, the antenna feet 43 have a bearing portion 43' which projects by a small amount towards the radiator element in parallel with the screws 45 and which passes through or enters a corresponding bore or through-opening 105*h* in the rear side 105*f* of the radome. The axial height parallel to the screw 45 of this bearing portion 43' corresponds to the material thickness of the radome 105, or of the rear wall 105*f* of the radome 105, or has a smaller thickness relative thereto, so that the rear wall 105*f* of the radome 105 is firmly pressed in and thereby held between the rear side 22*c* of the side web 22'*a* of the anchoring portion 21 and the shoulder portion 43" (which surrounds the bearing portion 43' of the antenna feet 43).

The mentioned U-shaped anchoring portion 21 has, as described, two metal side webs 22*a*, 22'*a*, wherein each of those two metal side webs 22*a*, 22'*a* can serve as the mounting plane ME or as the sectional plane SE, to which the active components can ultimately be anchored directly or indirectly. The sectional plane SE, along which the first component compartment 29 merges into the second component compartment 41 or is divided into those two component compartments 29, 41, will ultimately extend in that region.

A corresponding cross-sectional view similar to FIG. 2*b* is shown in FIG. 6, wherein in FIG. 6, in a departure from FIG. 2*b*, the additional second and/or active components 141 are also accommodated and mounted in the second and/or active component compartment 41, that is to say the so-called second or active component plane 41'. Since, as mentioned, the second screening walls 27 project in the rearward direction H beyond the corresponding sectional and mounting plane for accommodating these active components, namely at different settable heights, the desired optimal screening is also achieved for these active components 141. The overhang, that is to say the amount M by which the second screening wall 27 projects beyond the mounting plane ME (which thus also forms a sectional plane SE) in the rearward direction H, can in this case be so designed and adjusted that the desired screening effect occurs to a sufficient extent for the second or active components 141. In other words, this amount M can have a value which corresponds to at least 5%, preferably at least 10%, 15%, 20%, 25%, 30%, 35%, 40%, 45% or at least 50% of the height or depth T of the second or active components 141 (FIG. 6). This amount M, by which the screening wall projects beyond the mounting plane ME in the rearward direction H, can therefore be at least 5 mm, preferably at least 7.5 mm, 10 mm, 12.5 mm, 15 mm, 17.5 mm or at least 20 mm or more.

By means of FIG. 7, in a departure from the view according to FIG. 2*b*, a single-column antenna is shown.

The overall structure is, however, comparable to the embodiment described above. In the case of the single-column antenna, the actual reflector 10, on which the radiators or radiator groups 13 are mounted, merges via the side webs 10*a* directly into a connection web 18 on both sides, which is then followed, via a further angled portion, by the first screening wall 19, the corresponding anchoring portion 21 and the second screening wall 27.

FIG. 8 merely shows, in a departure, that further modifications in respect of the design of the complete reflector 16 are also possible within the scope of the invention. In the mentioned variant according to FIG. 8, it is shown, only schematically, that the first screening wall 19 can merge directly into the second screening wall 27, that is to say extends beyond the so-called mounting plane ME before being guided back again, via one or, for example, two corresponding angled portions 51, 53 (that is to say two 90° bends 51 or a continuous 180° bend 52), to the level of the mounting plane ME. At the level of this mounting plane, the anchoring portion 21 so formed then merges, in the manner of a U-shaped mounting web 22 which in this embodiment is open at the top, into a following mounting flange 22*d*, which is situated at the level of the mounting plane ME and extends in that plane. In this case, the outwardly facing web wall 22*a* of the anchoring portion 21 of U-shaped cross section, that is to say of the U-shaped mounting portion 22, is part of the second screening wall 27. In a departure from FIG. 8, the two webs 22*a*, extending in parallel, of the anchoring portion of U-shaped cross section can in this case have a bent portion 52 which is so narrow that these two portions rest on one another over their entire surface, that is to say do not have to form a spacing therebetween. However, in order to avoid passive intermodulations (PIM), preference is given at this point to a variant in which there is a minimum distance between the two above-mentioned parts, which distance is ensured by the interposition of a dielectric or of any other spacer, for example. In all these cases too, the radome 105 can overlap the complete reflector 16 thus formed, wherein in this case the anchoring or mounting portion 21, 22 comprising the two web walls 22*a* engages into the slot- or groove-shaped pocket 109 in the radome 105.

In this case, the plug strip 133 would also be mounted on the outwardly extending mounting flange 22*d* or on an angled shoulder 22*e* projecting therefrom.

In a preferred embodiment, the mentioned complete reflector 16 can consist of and be produced from a stamped and folded, that is to say bent, metal part, that is to say in particular a sheet-metal or metal plate. In order to reduce the weight, the reflector can also optionally be provided with a pattern of holes. A complete reflector 16 in such a form, having appropriate dimensions, is able to absorb the necessary weights, including wind forces. This is preferably achieved, as mentioned, in that the radome 105 and the complete reflector 16 are matched and adapted to one another in terms of their dimensions so that, as a result of the mutual support in the mounted state and the reinforcement achieved thereby, much higher loads can be absorbed and supported than would be expected from the sum of the individual constituents per se.

In an alternative embodiment, the complete reflector 16 can, however, likewise be formed form a continuously cast or extruded part, for example from an extruded metal part, for example using aluminium.

It is clear from the described embodiments that the radome is completely closed in the circumferential direction in large regions of its longitudinal extent. The design can preferably be such that the radome 105 is closed in the circumferential direction over more than 20%, in particular over more than 30%, 40%, 50%, 60%, 70%, 80% or more than 90% of its total length.

The mentioned mounting plane ME and/or the so-called sectional plane SE can be situated, relative to the anchoring portions 21, other than shown in the drawings, namely can be positioned closer to the actual reflector plane C or offset further away therefrom. Furthermore, the mounting and/or sectional plane ME and/or SE does not necessarily have to be designed to extend only in one contour line. The plane can ultimately have steps or extend in an angled manner. These planes represent only a notional separating plane between the first component compartment 29 and the second component compartment 41. In other words, independently of the specific attachment of the active components, they can, for example, also project into the so-called first component compartment 21 at least in part. Conversely, parts that are accommodated in the first component compartment 29 can also project beyond the so-called mounting or sectional plane into the second component compartment 41.

The invention claimed is:

1. Antenna comprising:

a complete reflector having a front side and a rear side, a plurality of radiators arranged in one or in a plurality of antenna columns on the reflector front side, which antenna columns extend in parallel with one another, the complete reflector being formed in one piece or integrally connected to at least one of the plurality of reflectors, or the complete reflector comprises at least one or the plurality of reflectors, a first component and/or wiring compartment provided on the reflector rear side opposite the radiators for accommodating components and/or wiring leading to the radiators, a housing in the form of a radome to put up the at least one reflector and the associated radiators as well as the components and/or wirings, the radome comprising a radome wall in the direction of radiation of the radiators, the complete reflector comprising at each of two outer longitudinal sides extending in the longitudinal direction a first screening wall which screens the first component and/or wiring compartment, the first screening walls each followed directly or indirectly by a second screening wall, and the two second screening walls extending at the longitudinal sides of the complete reflector projecting in the rearward direction of the antenna beyond a mounting plane or a sectional plane, along which the first component and/or wiring compartment is separated or divided into the first component and/or wiring compartment and a second component compartment whereby the second component compartment is provided for housing active components, the radome comprising a rear wall which is connected in one piece with the front side radome wall via the radome side walls, the radome having in cross section from its side wall portions in the transition region to its rear wall a slot- and/or groove-shaped pocket in which the associated second screening wall engages in the mounted state, and the complete reflector comprising the mounted radiators and comprising its first component and/or wiring compartment can be axially guided into and/or out of the radome.

2. Antenna according to claim 1, wherein the radome is closed in the circumferential direction over more than 20% of its total length.

3. Antenna according to claim 2, further comprising plug interfaces in the first component and/or wiring compartment and by that lies in the reflector interior, directly behind an opening provided in the rear wall of the radome.

4. Antenna according to claim 3, wherein the plug interfaces comprises a plurality of plug-in connectors which are held mounted on a plug strip, and are mounted on the complete reflector in the region of the anchoring and/or mounting portion.

5. Antenna according to claim 1, wherein the one-part or integral complete reflector consists of a metal plate or sheet metal, in the form of a stamped and folded part or stamped and bent part, which is provided with a pattern of holes.

6. Antenna according to claim 1, wherein side wall portions of the radome are of such a size that they extend as far as the lower most limiting edge of the second screening wall, the limiting edge being furthest away from the radiators, where the side wall portions have a narrowly defined curfed portion in order to form in each case an inner wall portion on the inner side of the second screening wall facing one another whereby the inner wall portions taper towards one another so as to form a rear wall.

7. Antenna according to claim 1, wherein, with regard to each antenna column, the reflector has at its sides extending in the longitudinal direction a reflector web which rises with respect to the reflector plane at least with one component in the direction of radiation and then merges into a connection web which is oriented to extend in parallel with the reflector plane.

8. Antenna according to claim 7, wherein two antenna columns arranged next to one another are integrally interconnected via a connection web which connects two adjacent reflector webs of two adjacent antenna columns.

9. Antenna according to claim 7, wherein the outermost reflector webs situated furthest away from one another are each integrally connected to the associated first screening wall via a connection web which extends in parallel with the reflector plane.

10. Antenna according to claim 7, wherein the complete reflector rests on the inner wall of the radome in the region of its connection webs and/or of its transition region to the first screening wall.

11. Antenna according to claim 10, wherein bead-shaped or web-shaped elevations, which extend in the longitudinal direction or are offset in the longitudinal direction are formed on the inner wall of the radome, which elevations are in contact with the complete reflector and are supported thereon, at the transition region of the first screening wall to the associated side web connected thereto or on the side web.

12. Antenna according to claim 1, wherein the complete reflector comprises an anchoring and mounting portion for mounting active components and/or whereby a sectional plane for mounting active components is formed by the anchoring and mounting portion.

13. Antenna according to claim 12, wherein the anchoring and mounting portion comprises a U-shaped mounting portion which is U-shaped and is so arranged that its opening region faces the particular longitudinal side of the complete reflector, with the formation of two side webs which are offset relative to one another transversely to the reflector plane, the side web that is further away from the radiators forming the mounting plane or sectional plane for mounting the active components.

14. Antenna according to claim 13, wherein the anchoring portion is formed in the manner of a U-shaped mounting portion between the first and second screening walls.

15. Antenna according to claim 1, wherein the first screening wall merges in each case into the associated second screening wall connected thereto, the second screening wall having a following wall portion which is turned back and guided back towards the radiators, and which merges into a mounting flange which extends transversely thereto and in parallel with the reflector plane, and to which the active components are anchored at least indirectly.

16. Antenna according to claim 1, wherein the complete reflector consists of an extruded metal part.

17. Antenna according to claim 1, wherein the second screening walls project beyond the mounting plane and/or the sectional plane by an amount which corresponds to at least 5% or more of the height or depth of the second or active components.

18. Antenna according to claim 1, wherein the second screening walls project beyond the mounting plane and/or the sectional plane by an amount which is at least 5 mm.

19. Antenna according to claim 1, wherein the complete reflector and the radome are fixed to one another via screw connections which are screwed in via bores provided in the rear wall of the radome in anchoring portions of the complete reflector and/or are secured by nuts.

20. Mobile radio antenna comprising:

a plurality of radiators arranged in a plurality of antenna columns extending in parallel with one another, the plurality of radiators having a radiation direction, a complete reflector being formed in one piece or integrally connected to at least one of the plurality of reflectors, or comprising at least one or the plurality of reflectors, the complete reflector having a front side, a rear side and first and second outer longitudinal sides each extending in a longitudinal direction, a housing which comprises a radome in the radiation direction, at least one component and/or wiring compartment provided on the reflector rear side opposite the radiators, the complete reflector and the at least one component and/or wiring compartment provided on the reflector rear side being at least partially accommodated within the housing, at least one further, active component compartment, the complete reflector comprising first screening walls at each of the first and second outer longitudinal sides extending in the longitudinal direction, the first screening walls being structured to screen the at least one passive component and/or wiring compartment, the first screening walls each followed directly or indirectly by a second screening wall, the second screening walls extending at the longitudinal sides of the complete reflector projecting in a rearward direction of the antenna beyond a mounting or sectional plane, along which the at least one passive component and/or wiring compartment is separated or divided from the at least one active component compartment;

the radome putting up the at least one reflector and associated radiators as walled components and/or wirings, the radome comprising a radome wall in the direction of radiation of the radiators, the radome comprising a rear wall which is connected in one piece with the front side radome wall via the radome side walls, the radome has in cross-section from its side wall portions in a transition region to its rear wall a slot- and/or groove-shaped pocket in which the associated second screening wall engages in the mounted state, the complete reflector comprising the mounted radiators and the component and/or wiring compartment being axially guided into and/or out of the radome.

* * * * *